US007705060B2

(12) United States Patent
Hoek et al.

(10) Patent No.: US 7,705,060 B2
(45) Date of Patent: Apr. 27, 2010

(54) METHOD TO START A PROCESS FOR PRODUCING HYDROCARBONS FROM SYNTHESIS GAS

(75) Inventors: Arend Hoek, Amsterdam (NL); Lip Piang Kueh, Sarawak (MY)

(73) Assignee: Shell Oil Company, Houston, TX (US)

( * ) Notice: Subject to any disclaimer, the term of this patent is extended or adjusted under 35 U.S.C. 154(b) by 32 days.

(21) Appl. No.: 12/096,409

(22) PCT Filed: Dec. 6, 2006

(86) PCT No.: PCT/EP2006/069351

§ 371 (c)(1),
(2), (4) Date: Jun. 30, 2008

(87) PCT Pub. No.: WO2007/065902

PCT Pub. Date: Jun. 14, 2007

(65) Prior Publication Data

US 2008/0275142 A1 Nov. 6, 2008

(30) Foreign Application Priority Data

Dec. 9, 2005 (EP) ..... 05111884

(51) Int. Cl.
*C07C 27/00* (2006.01)

(52) U.S. Cl. ..... 518/720; 518/700; 518/709; 518/715

(58) Field of Classification Search ..... 518/700, 518/709, 715, 720
See application file for complete search history.

(56) References Cited

U.S. PATENT DOCUMENTS

| | | | | |
|---|---|---|---|---|
| 2,602,810 A | | 7/1952 | Montgomery et al. | 260/449.6 |
| 2,610,976 A | | 9/1952 | Martin et al. | 260/449.6 |
| 2,693,481 A | * | 11/1954 | Fellows | 518/720 |
| 2,904,576 A | | 9/1959 | McGrath | 260/449.6 |
| 4,626,552 A | | 12/1986 | Arcuri | 518/712 |
| 5,292,705 A | * | 3/1994 | Mitchell | 502/325 |
| 5,763,716 A | | 6/1998 | Benham et al. | 585/315 |
| 6,475,943 B1 | * | 11/2002 | Hoek et al. | 502/53 |
| 2004/0077736 A1 | | 4/2004 | Steynberg | 518/703 |
| 2005/0027020 A1 | | 2/2005 | Steynberg | 518/718 |

FOREIGN PATENT DOCUMENTS

| | | |
|---|---|---|
| EP | 0152652 | 8/1985 |
| GB | 845558 | 8/1960 |
| WO | WO9306041 | 4/1993 |
| WO | WO9717137 | 5/1997 |
| WO | WO9961550 | 12/1999 |
| WO | WO02059232 | 8/2002 |
| WO | WO03068715 | 8/2003 |
| WO | WO2004015028 | 2/2004 |
| WO | WO2004026994 | 4/2004 |
| WO | WO2005026292 | 3/2005 |
| WO | WO2005026293 | 3/2005 |

OTHER PUBLICATIONS

Oil and Gas Journal, Sep. 6, 1971, pp. 86-90.

* cited by examiner

*Primary Examiner*—Jafar Parsa
*Assistant Examiner*—Yate' K Cutliff

(57) ABSTRACT

The present invention provides a method to start a steady state process for producing normally gaseous, normally liquid and optionally normally solid hydrocarbons from synthesis gas, which method comprises the steps of: (i) providing an activated catalyst in tubes of a fixed bed reactor, preferably a multitubular fixed bed reactor, the catalyst being suitable to convert synthesis gas to normally gaseous, normally liquid and optionally normally solid hydrocarbons; (ii) contacting the activated catalyst with a liquid to obtain a wetted activated catalyst; (iii) contacting the wetted activated catalyst with synthesis gas and catalytically converting the synthesis gas at an elevated temperature and pressure to obtain the normally gaseous, normally liquid and optionally normally solid hydrocarbons.

9 Claims, No Drawings

METHOD TO START A PROCESS FOR PRODUCING HYDROCARBONS FROM SYNTHESIS GAS

The present application claims priority to European Patent Application 05111884.2 filed 9 Dec. 2005.

FIELD OF THE INVENTION

The present invention provides a method to start a steady state catalytic process for producing normally gaseous, normally liquid and optionally solid hydrocarbons starting from synthesis gas, for example by a Fischer-Tropsch process.

BACKGROUND OF THE INVENTION

Many documents are known describing processes for the catalytic conversion of (gaseous) hydrocarbonaceous feedstocks, especially methane, natural gas and/or associated gas, into liquid products, especially methanol and liquid hydrocarbons, particularly paraffinic hydrocarbons. In this respect often reference is made to remote locations and/or off-shore locations, where no direct use of the gas is possible. Transportation of the gas, e.g. through a pipeline or in the form of liquefied natural gas, is not always practical. This holds even more in the case of relatively small gas production rates and/or fields. Reinjection of gas will add to the costs of oil production, and may, in the case of associated gas, result in undesired effects on the crude oil production. Burning of associated gas has become an undesired option in view of depletion of hydrocarbon sources and air pollution.

The Fischer-Tropsch process can be used for the conversion of synthesis gas (from hydrocarbonaceous feed stocks) into liquid and/or solid hydrocarbons. Generally, the feed stock (e.g. natural gas, associated gas and/or coal-bed methane, heavy and/or residual oil fractions, coal, biomass) is converted in a first step into a mixture of hydrogen and carbon monoxide (this mixture is often referred to as synthesis gas or syngas). The synthesis gas is then fed into a reactor where it is converted in one or more steps over a suitable catalyst at elevated temperature and pressure into paraffinic compounds ranging from methane to high molecular weight compounds comprising up to 200 carbon atoms, or, under particular circumstances, even more.

Numerous types of reactor systems have been developed for carrying out the Fischer-Tropsch reaction. For example, Fischer-Tropsch reactor systems include fixed bed reactors, especially multi-tubular fixed bed reactors, fluidised bed reactors, such as entrained fluidised bed reactors and fixed fluidised bed reactors, and slurry bed reactors such as three-phase slurry bubble columns and ebullating bed reactors.

The Fischer-Tropsch reaction is very exothermic and temperature sensitive, with the result that careful temperature control is required to maintain optimum operation conditions and desired hydrocarbon product selectivity. Indeed, close temperature control and operation throughout the reactor are major objectives.

Starting up such a process will involve new and regenerated catalyst material. However, catalyst material when new is often more active than when it has achieved a steady state activity under reaction conditions. In chemical reactions such as the Fischer-Tropsch reaction, which is very exothermic and temperature sensitive as mentioned above, a higher level of activity of a catalyst at the start up of a reactor is a significant concern.

There is thus required a way of using the initial greater activity of new catalyst material until the reaction process reaches a steady state. Several start-up procedures have been proposed in the prior art to cope with the initial greater activity of the catalyst.

In WO 03/068715 for example is described a process for starting up a Fischer-Tropsch slurry reactor wherein an initial charge of molten wax is established in a Fischer-Tropsch reactor. The reactor contains a portion of its steady state catalyst inventory in contact with the molten wax. The catalyst is supplied to the reactor in the form of a slurry of molten wax and catalyst particles. The reactor preferably contains clean molten wax without catalyst particles and a slurry of molten wax and catalyst particles is then mixed with the clean wax. At start-up, syngas at a flow rate below the steady state flow rate and a $H_2/CO$ ratio above the steady state ratio is contacted with the catalyst at a temperature below the steady state temperature.

In WO 2005/026292 and WO 2005/026293 is disclosed a method for start-up of a hydrocarbon synthesis process in a slurry bubble column. The start-up method comprises a specific procedure for charging the catalyst particles via a charging vessel into the conversion reactor. At the end of the charging phase, the reactor is kept at a temperature ranging from 150 to 220° C. and a pressure ranging from 1 to 10 bar and is continuously fed with inert gas to prevent catalyst sedimentation. During a conditioning phase, the temperature is brought to values suitable for conditioning, the inert gas is gradually substituted by synthesis gas up to a concentration ranging from 5-50 vol % and this concentration is maintained for 24-72 hours. Then, the pressure and temperature are gradually increased up to steady state regime values and the concentration of inert gas gradually reduced to zero.

SUMMARY OF THE INVENTION

It has now been found that by wetting an activated synthesis gas conversion catalyst that is loaded in the tubes of a fixed bed reactor prior to contacting the catalyst with synthesis gas, the activity of the catalyst is moderated and over-conversion of the synthesis gas at its initial contact with the catalyst can be prevented.

Accordingly, the present invention provides a method to start a steady state process for producing normally gaseous, normally liquid and optionally normally solid hydrocarbons from synthesis gas, which method comprises the steps of:

(i) providing an activated catalyst in tubes of a fixed bed reactor, preferably a multitubular fixed bed reactor, the catalyst being suitable to convert synthesis gas to normally gaseous, normally liquid and optionally normally solid hydrocarbons;

(ii) contacting the activated catalyst with a liquid to obtain a wetted activated catalyst;

(iii) contacting the wetted activated catalyst with synthesis gas and catalytically converting the synthesis gas at an elevated temperature and pressure to obtain the normally gaseous, normally liquid and optionally normally solid hydrocarbons.

It has been found that thus contacting the activated catalyst with a liquid will reduce the initial apparent activity of the catalyst by filling the pores of the activated catalyst, thus reducing the likelihood of hot spots due to over-conversion to occur.

DETAILED DESCRIPTION OF THE INVENTION

In step (i) of the method according to the invention, an activated catalyst is provided in tubes of a fixed bed reactor.

The catalyst is a catalyst suitable for converting synthesis gas into hydrocarbons, i.e. a Fischer-Tropsch reaction. The activated catalyst may be provided in the tubes by loading an activated catalyst in the tubes, i.e. after ex-situ activation. Preferably, the activated catalyst is provided by loading a non-activated catalyst in the tubes, followed by in-situ activation of the catalyst.

Preferably, the reactor tubes are at least 1 metre in length.

Catalysts suitable for converting synthesis gas into hydrocarbons are known in the art and are usually referred to as Fischer-Tropsch catalysts. Any suitable catalyst known in the art may be used.

In step (ii) of the method according to the invention, the activated catalyst is contacted with a liquid to obtain a wetted activated catalyst. The amount of liquid should be sufficient to fill the catalyst pores. Preferably, the amount of liquid is at least 3 times the total volume of the catalyst pores, more preferably in the range of from 5 to 10 times the total volume of the catalyst pores. Catalyst pore volume may be determined by methods known in the art, for example by water adsorption or mercury intrusion techniques.

The liquid in step (ii) is liquid at the conditions at which it is contacted with the activated catalyst. Preferably, the liquid is a hydrocarbon or a mixture of hydrocarbons, more preferably a hydrocarbon wax or a gasoil. A particularly suitable liquid is a hydrocarbon fraction produced by a Fischer-Tropsch reaction, preferably a Fischer-Tropsch wax or a Fischer-Tropsch gasoil. The liquid preferably has a boiling point of at least 200° C., more preferably at least 230° C.

The liquid may be contacted with the activated catalyst at any temperature below the boiling point of the liquid, preferably at a temperature in the range of 25-200° C., more preferably in the range of from 40 to 180° C.

The liquid may be contacted with the activated catalyst at a pressure in the range of from 1 to 50 bar (absolute), preferably of from 1 to 20 bar, especially around 1 bar.

The contacting may be done in an upflow direction or a downflow direction.

Contacting the liquid with the activated catalyst is preferably done under nitrogen and/or methane.

Preferably, the contacting with liquid is stopped when the pores of the catalyst are filled with liquid. It is, however, possible to continue the contacting with liquid, even during step (iii), i.e. when the wetted catalyst is contacted with synthesis gas for hydrocarbon production. If the contacting with liquid is continued during step (iii) a liquid hydrocarbon fraction produced in step (iii) may suitably be used as the liquid.

The wetted activated catalyst is in step (iii) contacted with synthesis gas and the synthesis gas catalytically converted at elevated temperature and pressure to obtain normally gaseous, normally liquid and optionally normally solid hydrocarbons. Step (iii) is carried out in the same reactor tubes as step (ii).

Preferably, the present invention simulates, at start up, the catalytic conversion in a Fischer-Tropsch conversion reactor at steady state conditions, i.e. the "normalised catalytic conversion", after the initial greater activity period of the new or fresh catalyst.

The use of a wetted activated catalyst according to the method of the invention may not be sufficient to achieve the "normalised catalytic conversion". Therefore, the method according to the invention may comprise further measures to reduce the initial conversion, for example reducing in step (iii) during start-up the partial pressure of the synthesis gas entering the conversion reactor, the temperature and/or the total reactor pressure as compared to the steady state conditions. Preferably, synthesis gas partial pressure, temperature and total reactor pressure during start-up are controlled such that the space time yield of a conversion reactor during the initial or start-up phase is kept at the same value as during steady state operation. Space time yield expresses the yield as weight of $C_1$+ hydrocarbons produced per reactor volume per hour.

A particularly suitable example of a further measure to reduce the initial conversion is admixing the synthesis gas with one or more inert gases to form an admixture stream prior to contacting the synthesis gas with the wetted catalyst. With the addition of one or more inert gases, the synthesis gas only has a partial pressure in the admixture stream which is catalytically converted in the start up method. This helps to reduce the over-conversion that would otherwise occur by use of full synthesis gas pressure acting on new or regenerated catalyst material.

As the activity of the catalyst decreases in the start-up or initial period towards a steady state activity the amount of inert gas(es) in the admixture stream is reduced. The partial pressure of the synthesis gas could be increased in a number of stages, but at least in a way wherein its partial pressure is kept close to, preferably below, the expected pressure of synthesis gas in the reactor for steady state catalytic conversion.

The initial synthesis gas partial pressure in the conversion reactor could be any suitable pressure lower than the total reactor pressure which suits other start-up conditions, or the reactor conditions and/or products being provided by such reactor. The initial partial pressure of the synthesis gas in a conversion reactor could be 20-70% lower than the usual steady state total reactor pressure, preferably 30-60% lower.

The actual flow rate of synthesis gas entering the synthesis reactor preferably does not change or significantly change during this initial period, but its partial pressure will be such as to simulate as near as possible the normal or steady state space time yield. Thus, the partial pressure of the synthesis gas entering the conversion reactor during start-up is preferably controlled such that the space time yield of a conversion reactor during the initial or start-up phase is kept at the same value as during steady state operation. Space time yield expresses the yield as weight of $C_1$+ hydrocarbons produced per reactor volume per hour.

The one or more inert gases could be one or more selected from the group comprising: methane, nitrogen, ethane, propane, carbon dioxide, off gas from the process for producing hydrocarbons or post-conversion reactor gas from step (iii), preferably selected from the group comprising methane, off gas and post-conversion reactor gas.

The term "inert gas" as used herein can be 100% inert in itself for a Fischer-Tropsch process or reaction. The term also covers a gas stream containing one or more such inert gases. Examples of such streams are off gas from the process for producing hydrocarbons or post-conversion reactor gas from step (iii), which gas streams can include one or more gases that are inert for a Fischer-Tropsch process.

An advantage of using a lower initial partial pressure of synthesis gas in the reactor at start-up is that no lowering of reaction temperature to otherwise compensate for the initial greater activity of the catalyst may be required. Thus, high quality steam is produced and the period during which this is not yet produced is minimised. Moreover, a relatively high temperature has a positive effect on preventing water condensation in the reactor.

Preferably, the initial temperature for the catalytic conversion of the synthesis gas, i.e. the temperature at start-up, is wholly or substantially the same as the plant design, or steady state, temperature. At conditions of a high total reactor pressure, for example 45 bar (absolute) or higher, it may be advantageous to start the method with an initial temperature that is lower than the plant design or steady state temperature in order to avoid over-conversion. The temperature could then be adjusted to the steady state temperature as soon as the catalyst activity is decreased to such level that over-conversion does not occur under the prevailing conditions. If a lower initial temperature is used in any of the conversion reactors, the initial temperature may be in the range >0-30° C. lower than the steady state temperature, preferably 5-15° C. lower.

The method of the present invention is particularly usable for processes involving more than one synthesis gas conversion reactor, preferably 2-10 reactors. Such reactors may be in an arrangement or system with one or more conversion reactors for different reactions.

In the method of the present invention, at least the conversion reactor(s) to which the invention applies are preferably connected, either in parallel, in series, or both.

In a preferred embodiment, liquid hydrocarbons produced from a first conversion reactor are initially used to contact and wet an activated catalyst loaded in a second reactor. Once liquid hydrocarbons are produced in a first synthesis gas conversion reactor, at least a portion of them may be re-cycled to a second reactor that is started according to the method of the invention and thus used as the liquid to contact the activated catalyst in step (ii). The first reactor may or may not be started with the method according to the invention.

Preferably, the temperature and pressure regime used in each conversion reactor to which the method of the present invention applies is wholly or substantially the same or similar. Also, the or each conversion reactor to which the invention applies has preferably the same space time yield.

The synthesis gas that is contacted with the wetted activated catalyst may be provided by any suitable means, process or arrangement. This includes partial oxidation and/or reforming of a hydrocarbonaceous feedstock as is known in the art. The hydrocarbonaceous feedstock may be a gaseous or solid feedstock. Suitable solid feedstocks are for example coal and biomass, preferably lignocellulosic biomass. Suitable gaseous feedstocks are known in the art and include natural gas, associated gas, methane or a mixture of $C_1$-$C_4$ hydrocarbons. The partial oxidation of gaseous feedstocks, producing a gaseous mixture comprising carbon monoxide and hydrogen, can take place according to various established processes. These processes include the Shell Gasification Process. A comprehensive survey of this process can be found in the Oil and Gas Journal, Sep. 6, 1971, pp 86-90.

The $H_2$/CO molar ratio of the synthesis gas that is contacted with the catalyst is suitably between 1.5 and 2.3, preferably between 1.8 and 2.1. If desired, additional hydrogen may be added to synthesis gas produced via partial oxidation or reforming in order to obtain the desired $H_2$/CO molar ratio. Such additional hydrogen may be made by steam methane reforming, preferably in combination with the water gas shift reaction. Any carbon monoxide and carbon dioxide produced together with the hydrogen in such steam methane reforming step may be used in the hydrocarbon synthesis reaction or recycled to increase the carbon efficiency.

If the synthesis gas is provided by partial oxidation of a hydrocarbonaceous feedstock, a molecular oxygen containing gas is needed for the partial oxidation of the feedstock. This molecular oxygen containing gas can be air, oxygen enriched air, or substantially pure air. Production of oxygen or oxygen enriched air typically involves air compression and air separation, usually via cryogenic techniques but a membrane based process could also be used, e.g. the process as described in WO 93/06041. A turbine usually provides the power for driving at least one air compressor or separator of the air compression/separating unit. If necessary, an additional compressing unit may be used between the air separation process and the provision of synthesis gas to step (iii). The turbine and/or the optional additional compressing unit are preferably driven by steam generated in step (iii).

The present invention is particularly suitable for integrated processes. One effect of the present invention is to provide in minimal time steam of sufficient quality for use in other parts of the process, or ancillary or other connected processes, units or apparatus, such as an air separation unit (ASU). ASUs are often powered by steam generators, which generally require steam of sufficient quality, generally pressure, as a power source.

The steady state catalytic synthesis gas conversion process may be performed under conventional synthesis conditions known in the art. Typically, the catalytic conversion may be effected at a temperature in the range of from 100 to 600° C., preferably from 150 to 350° C., more preferably from 180 to 270° C. Typical total reactor pressures for the catalytic conversion process are in the range of from 1 to 200 bar absolute, more preferably from 10 to 100 bar absolute, even more preferable from 20 to 70 bar absolute.

As mentioned above, catalysts for producing hydrocarbons from synthesis gas are known in the art. Such catalysts typically comprise, as the catalytically active component, a metal from Group VIII of the previous IUPAC version of the Periodic Table of Elements such as that described in the $68^{th}$ Edition of the Handbook of Chemistry and Physics (CPC Press). Particular catalytically active metals include ruthenium, iron, cobalt and nickel. Cobalt is a preferred catalytically active metal.

It depends on the catalyst and the process conditions used in a Fischer-Tropsch reaction which hydrocarbon products are obtained. Preferably, a Fischer-Tropsch catalyst is used, which yields substantial quantities of paraffins, more preferably substantially unbranched paraffins. A most suitable catalyst for this purpose is a cobalt-containing Fischer-Tropsch catalyst.

The hydrocarbons produced in the process mentioned in the present description are suitably $C_{3-200}$ hydrocarbons, more suitably $C_{4-150}$ hydrocarbons, especially $C_{5-100}$ hydrocarbons, or mixtures thereof. These hydrocarbons or mixtures thereof are liquid or solid at temperatures between 5 and 30° C. (1 bar), especially at about 20° C. (1 bar), and usually are paraffinic of nature, while up to 30 wt %, preferably up to 15 wt %, of either olefins or oxygenated compounds may be present. Typically, mainly (at least 70 wt %, preferably 90 wt %) of $C_5$+ hydrocarbons are formed.

A part of the hydrocarbons produced in step (iii) may boil above the boiling point range of the so-called middle distillates. The higher boiling range paraffinic hydrocarbons, if present, may be isolated and subjected to a catalytic hydrocracking step, which is known per se in the art, to yield the desired middle distillates.

Therefore, the hydrocarbon synthesis process to which the start-up method according to the invention is applied preferably further comprises the step of catalytically hydrocracking higher boiling range paraffinic hydrocarbons produced in step (iii). Suitable conditions for the catalytic hydrocracking are known in the art.

The term "steady state" as used herein is a term well known in the art, and relates to a constant or regular, relative to the matter involved, value or position over a period of time. Minor variation in all chemical reactions is common even for a steady state process, but a steady state process is well known in the art wherein the expected output or result is relatively predictable over time. Such conditions may or may not also be optimal, or to provide optimum results.

Another definition of "steady state" relates to the overall and individual conditions, including pressures and temperatures, of the hydrocarbon synthesis plant design. Such conditions are fundamental conditions set for the plant, and their selection would be known to a person skilled in the art.

In relation to catalyst activity, new or regenerated catalyst when first used can have as much as 70% or higher greater activity of the expected or design or steady state activity. This heightened activity naturally reduces as the catalyst is used from the start up. Thus, the initial catalyst activity can be in the range 120-170%, preferably in the range 135-140%, of the steady state catalyst activity.

Any percentage mentioned in this description is calculated on total weight or volume of the composition, unless indicated differently. When not mentioned, percentages are considered to be weight percentages. Pressures are indicated in bar absolute, unless indicated differently.

What is claimed is:

1. A method to start a steady state process for producing normally gaseous, normally liquid and optionally normally solid hydrocarbons from synthesis gas, which method comprises the steps of:

(i) providing an activated catalyst in tubes of a fixed bed reactor, the catalyst being suitable to convert synthesis gas to normally gaseous, normally liquid and optionally normally solid hydrocarbons;

(ii) contacting the activated catalyst with a liquid hydrocarbon or a mixture of hydrocarbons to obtain a wetted activated catalyst;

(iii) contacting the wetted activated catalyst with synthesis gas and catalytically converting the synthesis gas at an elevated temperature and pressure to obtain the normally gaseous, normally liquid and optionally normally solid hydrocarbons.

2. A method as claimed in claim 1, wherein step (i) comprises first loading a non-activated catalyst in the tubes of the fixed bed reactor and then activating the loaded catalyst to provide the activated catalyst.

3. A method as claimed in claim 1, wherein the liquid is a hydrocarbon fraction produced by a Fischer-Tropsch reaction.

4. A method as claimed in claim 3, wherein the liquid is a Fischer-Tropsch gasoil.

5. A method as claimed in claim 1, wherein the liquid is a wax at ambient temperatures.

6. A method as claimed in claim 1, wherein the liquid has a boiling point of at least 200° C.

7. A method as claimed in claim 1, wherein the liquid contacts the catalyst at a temperature below the boiling point of the liquid and in the range of 25 to 200° C.

8. A method as claimed in claim 1, wherein the step of contacting the catalyst with the liquid is done under nitrogen and/or methane.

9. A method as claimed in claim 1, wherein the synthesis gas is admixed with one or more inert gases to form an admixture stream prior to being contacted with the wetted activated catalyst and wherein as the activity of the catalyst proceeds towards a steady state, the amount of inert gas(es) in the admixture stream is reduced.

* * * * *